United States Patent [19]

Fauls

[11] Patent Number: 4,946,168

[45] Date of Patent: Aug. 7, 1990

[54] MYTHOLOGY GAME HAVING AN ELEVATED GAME BOARD SURFACE REPRESENTING MOUNT OLYMPUS

[76] Inventor: Sean P. Fauls, 14013 Bramble La., No. 103, Laurel, Md. 20708

[21] Appl. No.: 453,907

[22] Filed: Dec. 20, 1989

Related U.S. Application Data

[63] Continuation of Ser. No. 245,801, Sep. 19, 1988.

[51] Int. Cl.[5] ..... A63F 3/00

[52] U.S. Cl. ..... 273/241; 273/249; 273/255; 273/251; 273/254; 273/290; D21/14

[58] Field of Search ..... 273/241, 249, 251, 252, 273/254, 255, 290

[56] References Cited

U.S. PATENT DOCUMENTS

D. 226,932 5/1973 Ledgerwood ..... 273/241
4,477,080 10/1984 Baker ..... 273/241

FOREIGN PATENT DOCUMENTS 2181359 4/1987 United Kingdom ..... 273/241

*Primary Examiner*—Benjamin Layno

[57] ABSTRACT

The invention herewith is a board game consisting of a Mount Olympus Game Board with a 3-dimensional mountain protruding about one foot high in the center of the aforesaid board, a War Game Board consisting of 64 squares, and game pieces, all having a mythological theme. The object of the game is to move around the Mount Olympus Game Board until reaching the top of the mountain; however, in the process, if a player lands on a War Space, that player must go to war on a separate War Game Board with another player. If a player lands on a space with a mythological character portrayed on it, that player must pick a god/goddess Card, which will either request something good or bad for the player to do. When a player lands on the Trinket Space, the player must play the Creature Game, which requires guessing which creature holds the Trinket in captivity and, thereby, has the Trinket within its hollowed out portion. If the player guesses correctly, he/she wins that Trinket. A specified number of Trinkets must be obtained before winning the game. The game is won by the first player to receive all of the required Trinkets and reach the top of Mount Olympus.

1 Claim, 9 Drawing Sheets

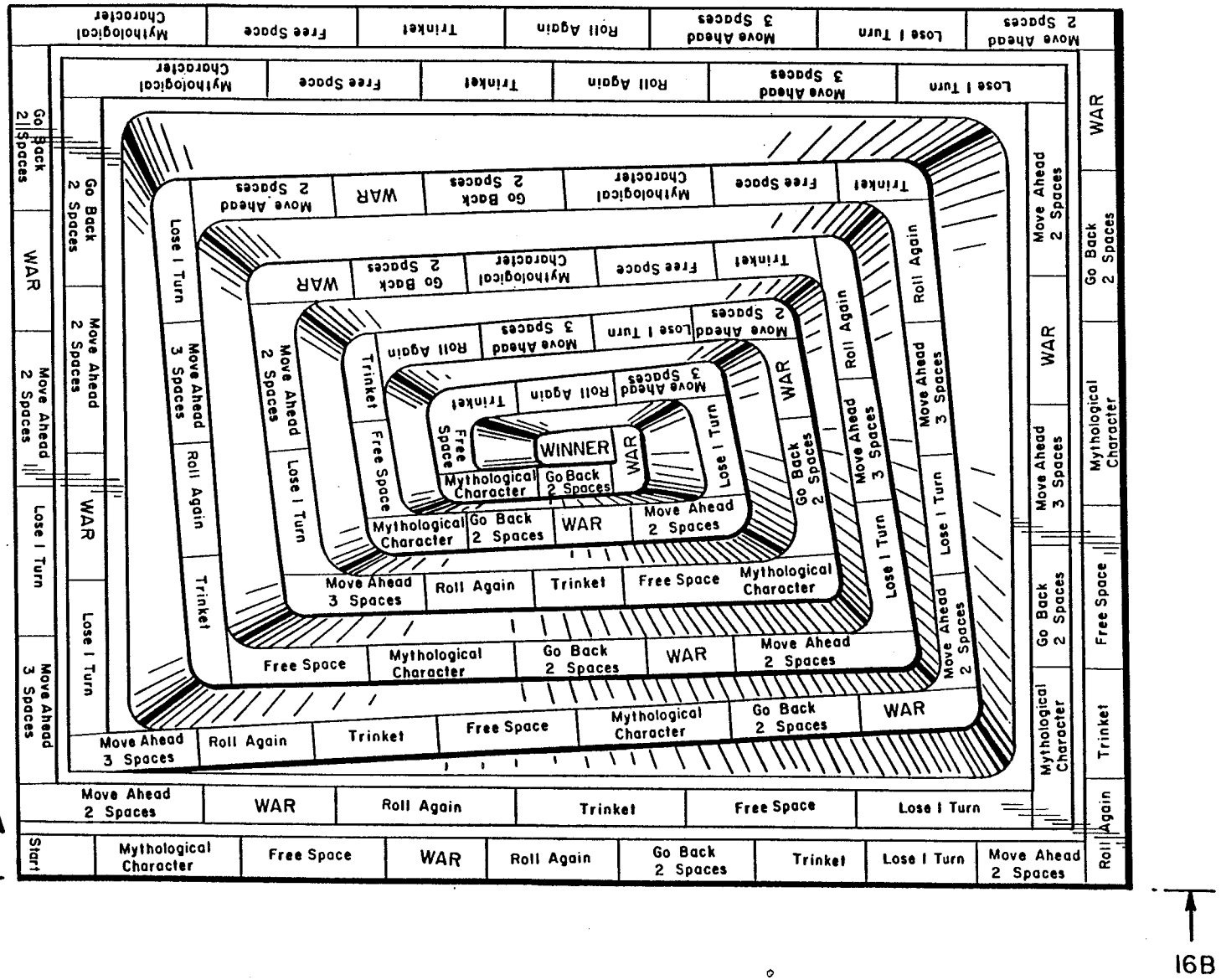
16B
Move Ahead 2 Spaces
Lose 1 Turn
Move Ahead 3 Spaces
Roll Again
Trinket
Free Space
Mythological Character
WAR
Go Back 2 Spaces
Mythological Character
Free Space
Trinket
Roll Again
Move Ahead 2 Spaces
Lose 1 Turn
Move Ahead 3 Spaces
Roll Again
Trinket
Go Back 2 Spaces
Move Ahead 2 Spaces
WAR
Lose 1 Turn
Start
Move Ahead 2 Spaces
Mythological Character
Free Space
WAR
Roll Again
Trinket
Go Back 2 Spaces
Mythological Character
Free Space
Trinket
Roll Again
Lose 1 Turn
Move Ahead 2 Spaces
Go Back 2 Spaces
Mythological Character
WAR
Move Ahead 2 Spaces
Lose 1 Turn
Move Ahead 3 Spaces
Roll Again
Trinket
Free Space
Mythological Character
Go Back 2 Spaces

MYTHOLOGY GAME HAVING AN ELEVATED GAME BOARD SURFACE REPRESENTING MOUNT OLYMPUS

This is a continuation, of application Ser. No. 07/245,801, filed Sept. 19, 1988.

SUMMARY OF THE INVENTION

The invention herewith is a board game consisting of a Mount Olympus Game Board with a mountain protruding about one foot high in the center of the aforesaid board, a War Game Board consisting of 64 squares, and game pieces, all having a mythological theme. The object of the game is to move around the Mount Olympus Game Board until reaching the top of the mountain; however, in the process, if a player lands on a War Space, that player must go to war on a separate War Game Board with another Player. If a player lands on a space with a mythological character portrayed on it, that player must pick a god/goddess Card, which will either request something good or bad for the player to do. When a player lands on the Trinket Space, the player must play the Creature Game, which required guessing which creature holds the Trinket in captivity and, thereby, has the Trinket within its hollowed out portion. If the player guesses correctly, he/she wins that Trinket. A specified number of Trinkets must be obtained before winning the game. The game is won by the first player to receive all of the required Trinkets and reach the top of Mount Olympus.

DESCRIPTION OF DRAWING VIEWS

The drawings attached herewith are as follows:

1. Trinkets
FIG. 1 Silver Sheep's Head
FIG. 2 Golden Staff
FIG. 3 Sacred Olive Leaf Wreath
FIG. 4 Torch
FIG. 5 Amulet
FIG. 6 Golden Key
2. Magical Weapons
FIG. 7 Sword
FIG. 8 Crossbow
FIG. 9 Boomerang
3. 18 Creatures (3 of each)
FIG. 10 Medusa
FIG. 11 Cyclops
FIG. 12 Three-Headed Giant
FIG. 13 Giant Octopus
FIG. 14 Sirens Maiden
FIG. 15 Centaur
4. Game Board
FIG. 16A is a top plan view of a game board representing Mount Olympus
FIG. 16B is a view of the game board taken along line 16B—16B of FIG. 16A
5. Game Board
FIG. 17 War Game Board
6. Warriors
FIG. 18 Male Warrior
FIG. 19 Female Warrior
FIG. 20 God Warrior
FIG. 21 Goddess Warrior
FIG. 7. Miscellaneous Pieces
FIG. 22 Die
FIG. 23 Markers
FIGS. 24–25 Mount Olympus Playing Pieces FIGS. 26–30 God/Goddess Cards
FIGS. 31–36 War Cards

DETAILED DESCRIPTION

Game Equipment:
1 Mount Olympus Game Board
1 War Game Board
10 Mount Olympus Playing Pieces
10 Markers
20 War Cards
8 War Playing Pieces (2 Male Warriors, 2 Female Warriors, 2 god Warriors, 2 goddess Warriors)
3 Magical Weapons (Sword, Crossbow, Boomerang)
6 Trinkets (Silver Sheep's Head, Golden Staff, Sacred Olive Leaf Wreath, Torch, Amulet, Golden Key)
18 Creatures (3 each of: Medusa, Cyclops, Three-Headed Giant, Giant Octopus, Sirens Maiden, Centaur)
1 Die

TO START THE GAME

Figure 16B:
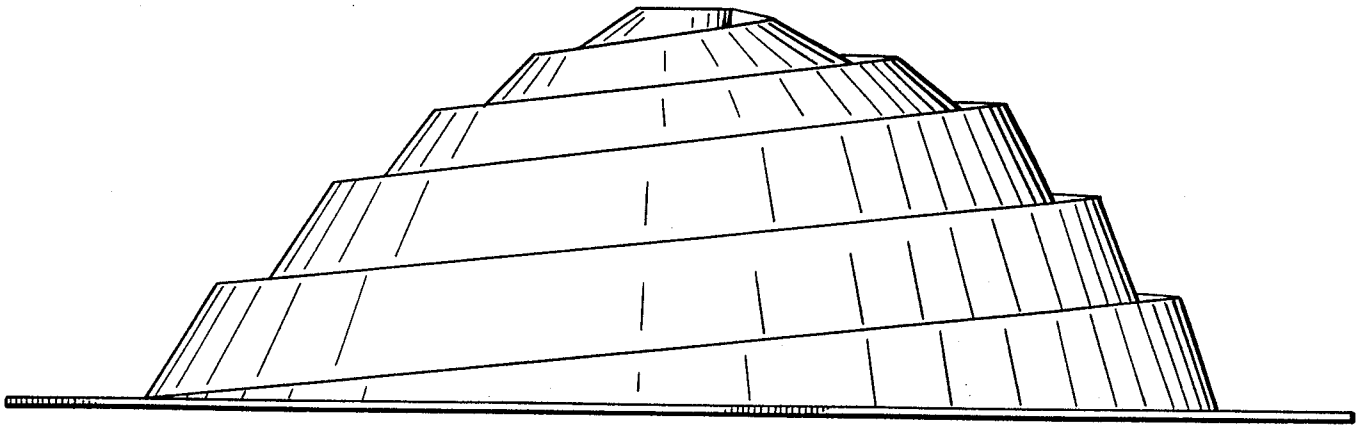
Figure 22:
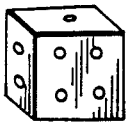
Figure 23:
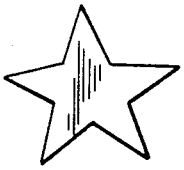
Figure 24:
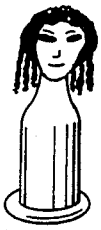
Figure 25:
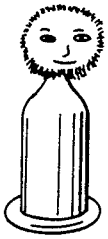
Figure 26:
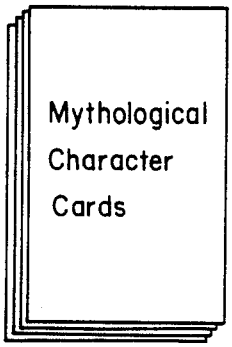
Figure 27:
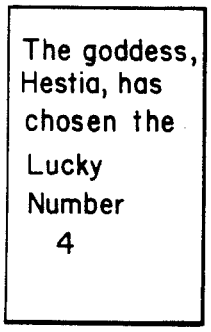
Figure 28:
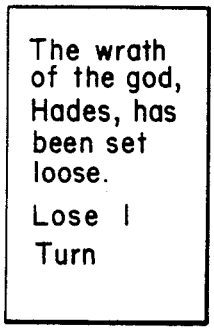
Figure 29:
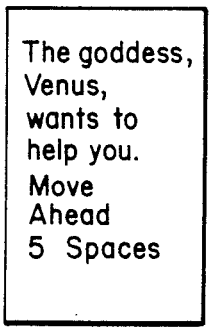
Figure 30:
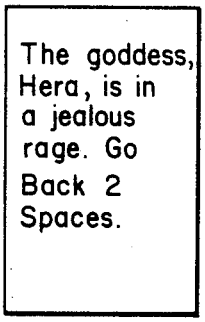
Figure 31:
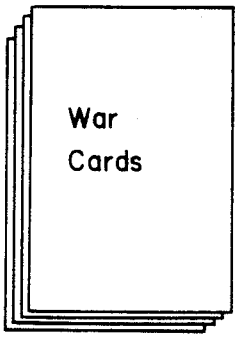
Figure 32:
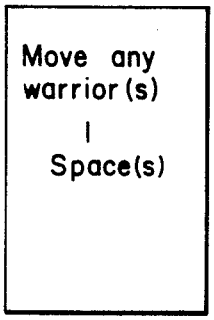
Figure 33:
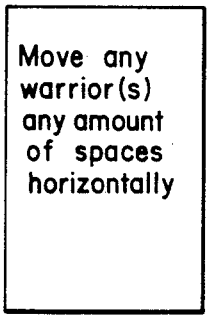
Figure 34:
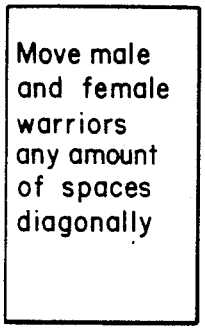
Figure 35:
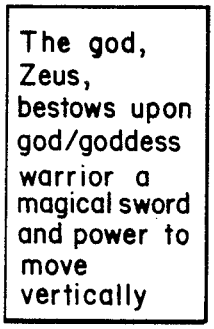
Figure 36:
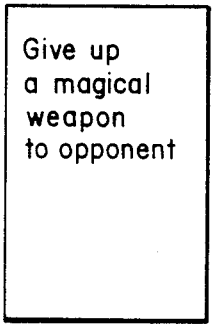

Each player chooses a Mount Olympus Playing Piece FIGS. 24–25 and places it on the space marked START on the Mount Olympus Game Board (FIG. 16). Each player rolls the die (FIG. 22). The highest roller moves first as the game begins. The player to the left then moves next, with the player sequence continuing in a clockwise manner. The players move around the flat portion of the Mount Olympus Game Board and then around the 3-dimensional protruding Portion of Mount Olympus in a spiral fashion until reaching the top.

FACETS OF THE GAME

WAR:

When a player lands on a special War Space then he/she ("Challenger") must go to war one other player of his/her choice.

Figure 17:
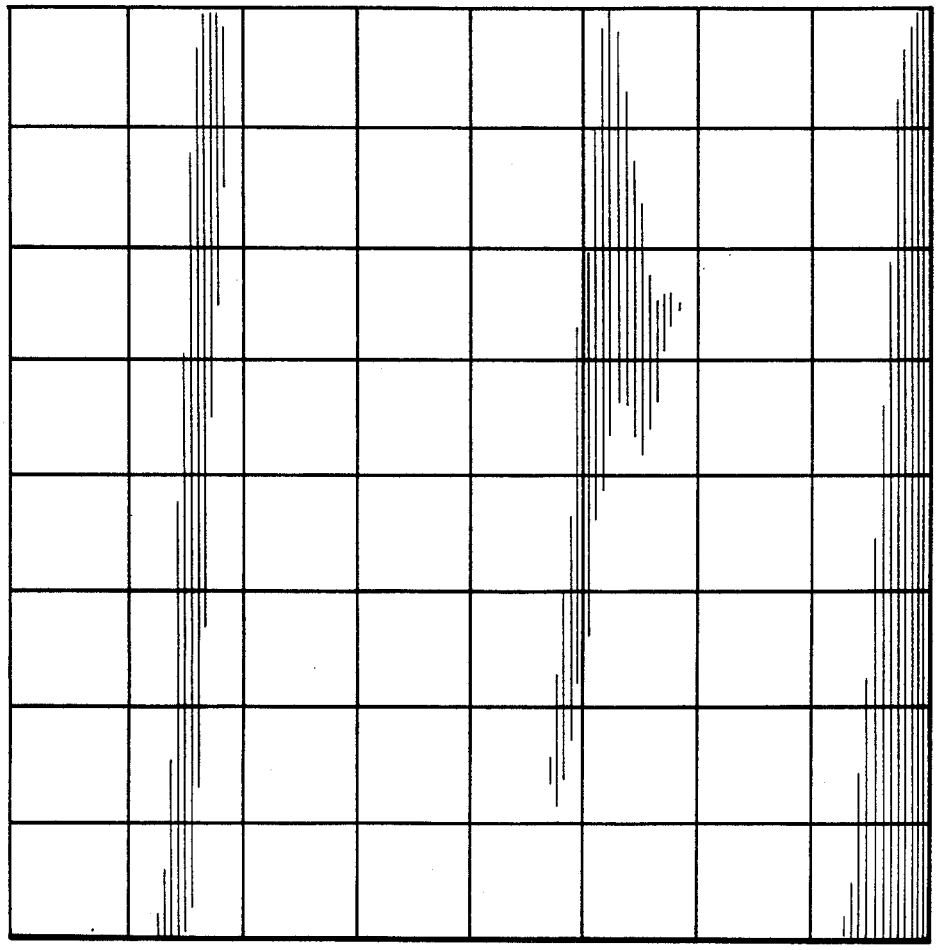
Figure 18:
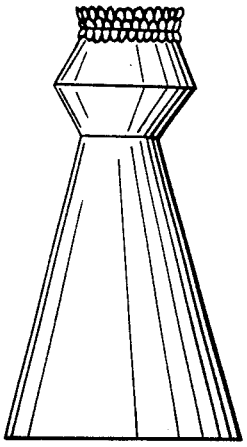
Figure 19:
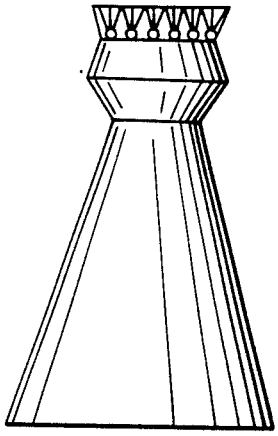
Figure 20:
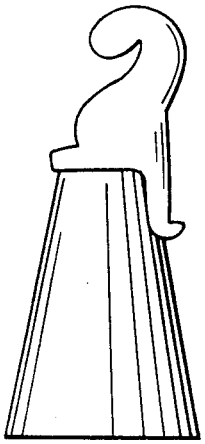
Figure 21:
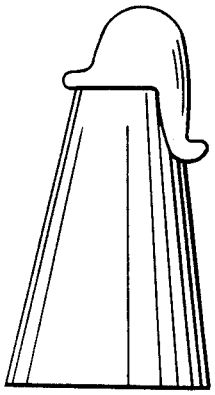

War takes place on a separate War Game Board (FIG. 17). Each player receives three playing pieces: one Male Warrior (FIG. 18), one Female Warrior (FIG. 19), and one god Warrior (FIG. 20) or goddess Warrior (FIG. 21) (player chooses either). By substituting the Markers (FIG. Y) on the Mount Olympus Game Board, the two war players take their Mount Olympus Playing Pieces off the Mount Olympus Game Board and place them inside the hollow portion of either the god Warrior Playing Piece or goddess Warrior Playing Piece on the War Game Board. The war players decide which color they are going to be, either gold or silver. That is the color of the playing pieces the war players then choose.

Figure 7:
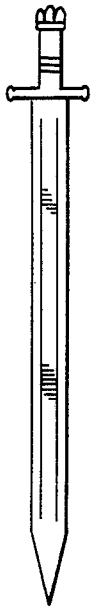
Figure 8:
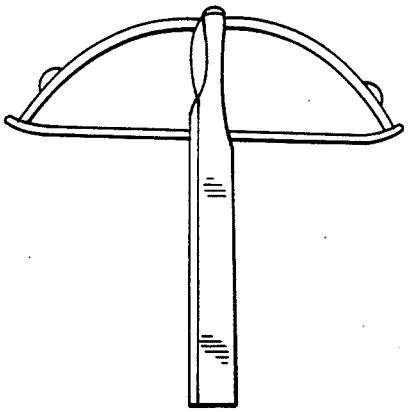
Figure 9:
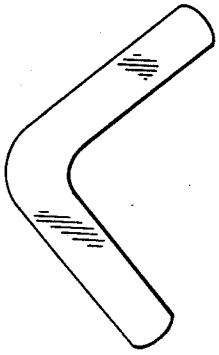

The War Playing Pieces are arranged on the 64-space War Game Board with one players War Playing Pieces on the right side of the War Game Board and the opponent's War Playing Pieces on the left side as follows: the god Warrior or goddess Warrior is placed on the back row in the center with a Male Warrior in front to the right and a Female Warrior in front to the left of the god Warrior or goddess Warrior, as the case may be. The Challenger goes first, picks a War Card (FIG. W), and makes a move according to the statement on the War Card. Play then continues as the opponent does the same thing. The Male, Female, god and goddess Warriors may move one space in any direction unless otherwise specified. In addition, the War Cards, when specific ones are drawn, may give powers to the Male and Female Warriors which enable them to move any amount of spaces in a particular specified direction. The War Cards constantly change the direction in which a war player may move his or her Warriors. Specific War Cards may also give Magical Weapons to the god/goddess Warriors which help them in battle. The three Magical Weapons are the Sword (FIG. 7), Crossbow (FIG. 8), and Boomerang (FIG. 9). Each Magical Weapon gives the god Warrior or goddess Warrior any amount of spaces in one specific direction for instance, sword-vertically; crossbow-horizontally; and boomerang diagonally. A collection of several Magical Weapons allows the god Warrior or goddess Warrior to move more directions. If all three Magical Weapons are obtained by one god Warrior or one goddess Warrior, then that god Warrior or goddess Warrior could move any number of spaces in all directions. This power remains until the end of the War Game unless the power is lost by drawing a specific card which states to give up a weapon to the opponent.

Attacking is accomplished by moving a War playing Piece in its alotted direction and coming into direct contact with one of the opponent's War Playing Pieces. Whoever captures their opponent's god Warrior or goddess Warrior first, wins; therefore, protection of the god Warrior or goddess Warrior is the objective of the Male Warrior and Female Warriors.

After war is completed, the winning player of the War Game puts his/her Mount Olympus Playing Piece back on the Mount Olympus Game Board, and Play resumes with it being the War Game winning player's turn, and the War Game lower going back to START.

MYTHOLOGICAL CHARACTERS

When a player lands on a space with a picture of a mythological character, a player picks a god/goddess Card (FIGS. 26–30), which will either tell the player something good or bad. Also, the god/goddess Card may say that the gods/goddesses have chosen a lucky number which will be between 1 and 6. The player must then roll the die. If what the player rolls is the same as the lucky number that the gods/goddesses have chosen, then the player may have an extra turn by rolling again; but if the player does not roll the lucky number, then higher turn has ended.

FREE SPACES

When a player lands on this space, a player treats it as a free space and does nothing except to remain there until it is that player's turn again.

TRINKETS

Figure 1:
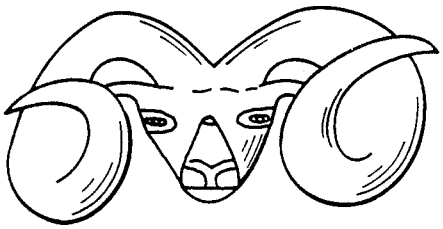
Figure 2:
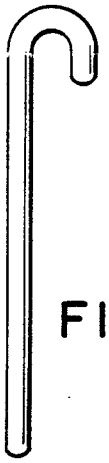
Figure 3:
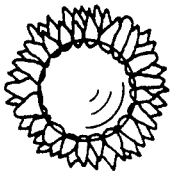
Figure 4:
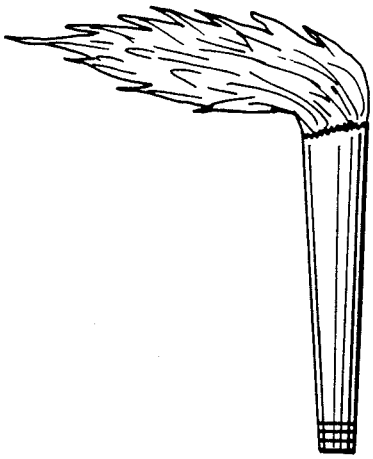
Figure 5:
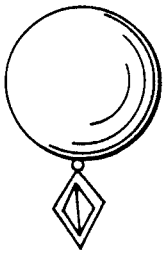
Figure 6:
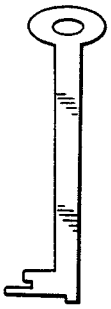
Figure 10:
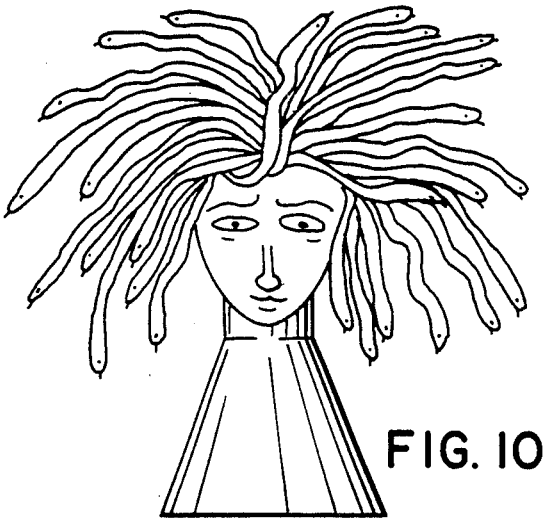
Figure 11:
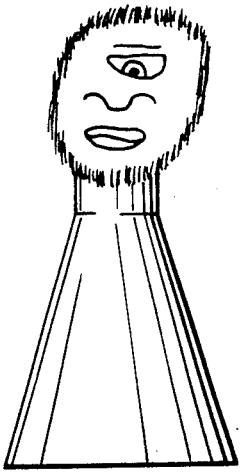
Figure 12:
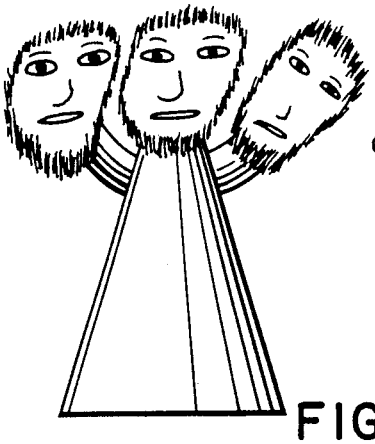
Figure 13:
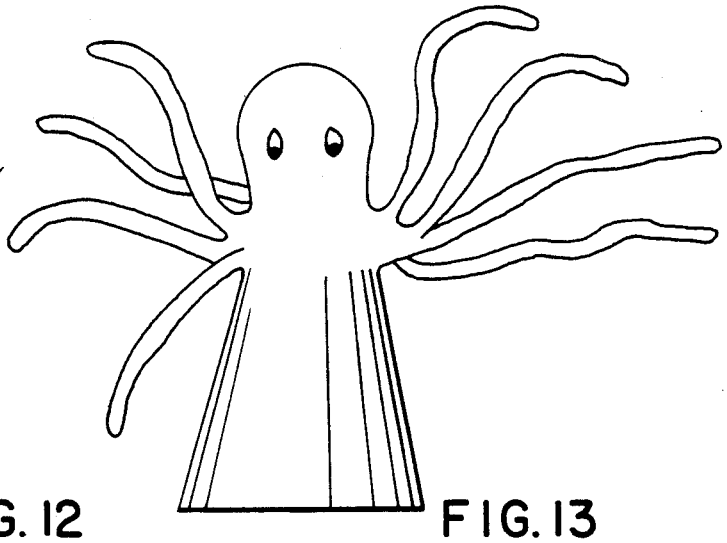
Figure 14:
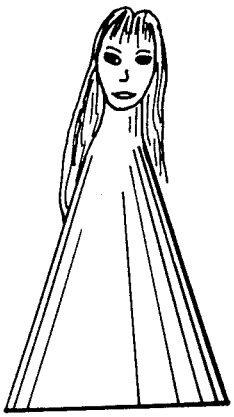
Figure 15:
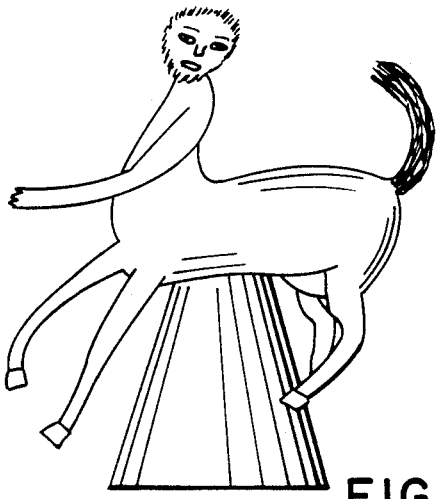

Trinkets are obtained by landing on, or going past a specific Trinket Space on the Mount Olympus Game Board. When this happens, the player must fight the particular Creature which holds in captivity the specific Trinket:

1. Medusa (FIG. 10), a Gordon with wings and hair of snakes. Trinket: Silver Sheep's Head (FIG. 1)
2. Cyclops (FIG. 11), a one-eyed giant. Trinket: Golden Staff (FIGS. 12).
3. Three-Headed Giant (FIG. 12). Trinket: Sacred Olive Leaf Wreath (FIG. 3)
4. Giant Octopus (FIG. 13). Trinket: Torch (FIG. 4)
5. Sirens Maiden (FIG. 14), one of several maidens who lured their victims with enchanting hypnotic voices. Trinket: Amulet (FIG. 5)
6. Centaur (FIG. 15), who was half man and half-horse. Trinket: Golden Key (FIG. 6)

The fight with there Creatures takes place as a Trinket specified by the Trinket Space landed on, is hidden inside the hollowed out portion under one of the three Creature Playing Pieces resembling the Creature specified by the Trinket Space landed on. The Creature Playing Pieces are then shuffled and the player must guess which Creature Playing Piece the Trinket is under. The player gets one guess per turn and cannot pass the Trinket Space until guessing correctly, which correct guess slays the Creature, enabling the player to capture the specific Trinket. if a player is requested, during the regular game on the Olympus Game Board, to go back past Trinket Space where he/she has already played the Creature, the player does not have to fight that Creature again, nor give up his/her Trinket, but simply treats that Trinket Space as if it were a Free Space.

Once a player has received each of the six different Trinkets, that player cannot receive any more, nor duplicates of any of the Trinkets. Each player must receive one of each of the six different Trinkets before winning the game.

WINNING

Winning the Mount Olympus Game is accomplished by reaching the very top space of Mount Olympus by an exact roll and by receiving all of the required trinkets.

I claim:

1. A board game including:

a primary game comprising a first game board having a flat playing surface and a 3-dimensional playing surface representative of a mountain, said first game board having a playing path extending along the flat playing surface and continuously extending along the 3-dimensional playing surface up to the top of said mountain, said playing path being divided into a plurality of spaces, a plurality of differently shaped trinket pieces, a set of first playing pieces, a random number generating means for determining the movement of said first playing pieces along the path;

a first secondary game comprising a second game board having a matrix of square spaces thereon, a set of second playing pieces, a set of instruction cards for determining the movement of said second playing pieces on said second game board;

said playing path having a set of first spaces having indicia corresponding to said first secondary game, whereon when a first playing piece lands on a first space said first secondary game is played;

a second secondary game comprising, a set of differently shaped third playing pieces, wherein each third playing piece has a hollowed out portion at the base thereof capable of covering a trinket playing piece;

said playing path having a set of second spaces each having an indicia corresponding to a differently shaped third playing piece, whereon when a first playing piece lands on a second space, said second secondary game is played using the corresponding third playing pieces to obtain a trinket piece.

* * * * *